US006235068B1

(12) United States Patent
Moreton

(10) Patent No.: US 6,235,068 B1
(45) Date of Patent: May 22, 2001

(54) FUEL COMPOSITION

(75) Inventor: David John Moreton, East Yorkshire (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/367,946

(22) PCT Filed: Jan. 7, 1999

(86) PCT No.: PCT/GB99/00049

§ 371 Date: Oct. 19, 1999

§ 102(e) Date: Oct. 19, 1999

(87) PCT Pub. No.: WO99/35217

PCT Pub. Date: Jul. 15, 1999

(30) Foreign Application Priority Data

Jan. 10, 1998 (GB) ..... 9800442

(51) Int. Cl.[7] ..... C10L 1/24; C10L 10/00

(52) U.S. Cl. ..... 44/370; 44/374

(58) Field of Search ..... 44/370, 374

(56) References Cited

U.S. PATENT DOCUMENTS

| | | | | |
|---|---|---|---|---|
| 2,533,303 | * | 12/1950 | Watkins | 44/370 |
| 2,886,422 | * | 5/1959 | Vitalis | 44/370 |
| 2,950,960 | * | 8/1960 | Barusch et al. | 44/370 |
| 3,307,928 | | 3/1967 | Chaikivsky et al. | 44/63 |
| 3,594,140 | * | 7/1971 | Badin | 44/370 |
| 4,182,613 | * | 1/1980 | Stover et al. | 44/370 |
| 4,440,625 | * | 4/1984 | Go et al. | 44/370 |
| 4,441,890 | * | 4/1984 | Feldman | 44/370 |
| 4,537,602 | * | 8/1985 | Rossi et al. | 44/370 |
| 4,615,841 | * | 10/1986 | Stamatakis et al. | 44/370 |
| 5,925,233 | * | 7/1999 | Miller et al. | 44/370 |

FOREIGN PATENT DOCUMENTS

| | | |
|---|---|---|
| 1073674 | 3/1980 | (CA) . |
| WO91/13951 | 9/1991 | (WO) . |
| WO97/44414 | 11/1997 | (WO) . |

* cited by examiner

*Primary Examiner*—Margaret Medley
(74) *Attorney, Agent, or Firm*—Jeffrey F. Munson; Michael F. Esposito; Joseph P. Fischer

(57) ABSTRACT

A fuel composition, comprising: a marine diesel fuel; and a liner lacquering reducing amount of a hydrocarbyl-substituted sulphonic acid. This invention also relates to a process for reducing liner lacquering in a marine diesel engine, comprising operating the diesel engine using the foregoing fuel composition.

8 Claims, No Drawings

FUEL COMPOSITION

This application is a 371 of PCT/GB99/00049 dated Jan. 07, 1999.

TECHNICAL FIELD

This invention relates to fuel compositions and, more particularly, to marine diesel fuel compositions. Specifically, this invention relates to a fuel composition comprising a marine diesel fuel and a liner lacquering reducing amount of a hydrocarbyl-substituted sulphonic acid.

BACKGROUND OF THE INVENTION

A problem recently observed in connection with marine diesel engines, particularly those operating on low-sulphur marine diesel fuel, is that of liner lacquering whereby a hard resin-like material forms on cylinder liners and fills the honing grooves. This problem manifests itself in increased lubricating oil consumption which incurs a financial penalty. A solution to the problem, namely replacing the cylinder liners at regular intervals, also carries a financial penalty in that the vessel is temporarily out of commission during replacement of the liners in addition to the cost of replacement itself.

Initially it was thought that the problem was caused by deficiencies in engine design. Later the problem was ascribed to poor lubricating oil quality. The working pattern of the engine and the loads thereon were also thought to be contributory factors. However, a recent paper presented at the 20th International Congress of Combustion Engines, London, 1993, entitled 'The Influence of Marine Fuel Quality On Lubricating Oil Performance' by R W Allen of Castrol International Marine presents a strong case for deteriorating marine diesel fuel quality being a major factor, together with engine overloading, in the occurrence of the problem. The paper makes the observation that gas oil sold into the marine market is in general of lower quality (higher boiling ranges end-point and higher aromatics content) and lower cost than that sold for automotive applications and concludes realistically that even though this type of fuel may be associated with the formation of liner lacquers in overloaded engines it will continue to be produced and sold because of its lower cost.

WO 97/44414 discloses that the problem can be significantly reduced by adding to the fuel a detergent and a combustion improver such as a cerium oxidic compound.

SUMMARY OF THE INVENTION

This invention relates to a fuel composition, comprising: a marine diesel fuel; and a liner lacquering reducing among of a hydrocarbyl-substituted sulphonic acid. This invention also relates to a process for reducing liner lacquering in a marine diesel engine, comprising operating the diesel engine using the foregoing fuel composition.

DESCRIPTION OF THE PREFERRED EMBODIMENTS

Marine diesel engines which are prone to liner lacquering problems are generally four stroke engines running on gas oils and to a lesser extent two stroke crosshead engines.

Marine diesel fuels of a quality capable of giving rise to liner lacquering are generally those having a high, typically greater than 340° C., and in one embodiment greater than 360° C., and in one embodiment greater than 420° C., temperature for a 90% volume recovery during distillation and a high, ie, greater than 25%, and in one embodiment greater than 35%, aromatics content. Generally this is accompanied by a low saturates content (less than 60%) and a low olefins content (less than 3%). The cetane number of such fuels is also generally about 40, or less. In addition, marine diesel fuels of a quality capable of giving rise to liner lacquering are generally those of a low sulphur content for example less than 2%, and in one embodiment less than 0.5%, less than 0.2% by weight.

The invention also relates to a marine diesel fuel additive composition comprising a hydrocarbyl-substituted sulphonic acid and a fuel soluble carrier or solvent. Thus, the invention, in one embodiment, comprises a marine diesel fuel comprising a marine diesel fuel and the foregoing additive composition. The carrier or solvent can be any known hydrocarbon solvent, with mineral oil being preferred. The concentration of the sulphonic acid in the carrier or solvent ranges from 1 to 75% by weight, and in one embodiment 33 to 50% by weight. The concentration of the additive composition in the fuel composition typically ranges from 15 to 50,000 ppm, and in one embodiment 1000 to 6000 ppm.

The hydrocarbyl-substituted sulphonic acids include the ($C_1$–$C_{24}$)alkyl sulphonic acids, ($C_6$–$C_{24}$)aryl sulphonic acids, and ($C_1$–$C_{24}$) alkyl ($C_6$–$C_{12}$) aryl sulphonic acids. Examples include alkyl substituted benzene sulphonic acid, alkyl substituted naphthylene sulphonic acid, and para-alkyl substituted phenol sulphonic acid. A preferred alkyl substituent on either the sulphonic acid or the aryl group is dodecyl. A useful compound is dodecylbenzenesulphonic acid.

The amount of hydrocarbyl-substituted sulphonic acid in the fuel may vary from 10 to 10000 ppm; the amount required depending at least partly on the quality, and particularly the sulphur content, of the fuel. Useful levels are from 100 to 5000 ppm, and in one embodiment from 500 to 2000 ppm.

In addition to the hydrocarbyl-substituted sulphonic acid, the marine diesel fuel may contain conventional additives such as detergents, combustion improvers, cetane improvers, emulsifiers and antioxidants. Diesel detergents function to prevent the build-up of deposits in inter alia the injection system, particularly the injector nozzle, of a diesel engine which can adversely affect both the fuel flow and fuel atomisation characteristics of the injector. The term 'diesel detergent' includes all those materials which would be suitable for use in diesel engines and which have detergent action, generally classified as dispersants which have detergency action. Detergency in diesel engines is generally associated with a range of amine type detergents and polymeric dispersants typified by the following compounds:- amines, imidazolines, amides, fatty acid succinimides, polyalkylene succinimides, polyalkylene amines and polyether amines. Useful detergents are (i) oil-soluble amides or imides of long-chain hydrocarbyl-substituted mono- or dicarboxylic acids or their anhydrides and (ii) long-chain hydrocarbons having a polyamine attached directly thereto. A useful detergent is an imide or amide formed by the reaction of a polyalkene substituted succinic acylating agent and an amine.

As regards the combustion improver, these are compounds which are useful in promoting the combustion of hydrocarbon fuels, in particular diesel fuels. They are believed to act as catalysts for the oxidation of combustion residues and exhaust gases of hydrocarbon fuels. Any of the additives which have been suggested for use in diesel fuels to reduce particulate emissions may be employed as a combustion improver, for example those described in U.S. Pat. Nos. 2,926,454; 3,410,670; 3,413,102; 3,539,312 and 3,499,742.

The optional cetane improver is preferably an alkyl nitrate, ether nitrate, dinitrate of a polyethylene glycol or a peroxide.

The antioxidant is useful for inhibiting gum formation during fuel storage. Diesel antioxidants in current use are mainly based on hindered phenol or amine, for example phenylenediamines, structures. Any of the commercially available diesel antioxidants may be employed.

Additives such as antifoams, for example polysilicone based compounds, corrosion inhibitors, for example carboxylic acids, amines, amides and amine salts of carboxylic acids, wax crystal modifiers/distillate flow improvers, etc., may be incorporated if desired.

The hydrocarbyl-substituted sulphonic acid or fuel additive composition containing it may be incorporated into the fuel during its manufacture, or alternatively may be blended into additive-free fuel contained in the fuel storage tanks of individual vessels.

The invention will now be further illustrated by reference to the following Examples. In these examples an attempt is made to simulate liner lacquer in the laboratory, and tests are then conducted to determine what would remove it. This is based on the theory that liner lacquer is caused by the oxidation in the presence of iron of anthracene (a typical polycyclic aromatic present in diesel) to form quinone species, which then deposit onto the cooler cylinder liners.

EXAMPLE 1

Formation of Synthetic 'Liner Lacquer'

Anthraquinone is dissolved in warm (65° C.) acetic acid to form a saturated solution. This is pipetted onto a warm (60° C.) steel dish, where the acetic acid is evaporated to leave a brown-orange lacquer, which is used as 'liner lacquer' for the purposes of the tests below.

EXAMPLE 2

Removal of Synthetic Lacquer by Sulphuric Acid

Approximately 2 ml of 0.1M sulphuric acid are dripped onto a sample of lacquer produced according to Example 1. The lacquer dissolves in less than one minute. This is consistent with the theory that in high-sulphur fuels where liner lacquering is not a problem, the sulphuric acid formed during combustion washes away the lacquer into the crankcase oil. However, in low sulphur fuels there is insufficient acid to do this.

EXAMPLE 3

Removal of Lacquer by Different Fuel Additives

Various additives are blended at 50% in a standard base oil, and a small amount of each blend placed on a sample of lacquer prepared according to Example 1. The dishes are then heated at 100° C. for one hour, after which time they are removed from the oven and drained. The lacquer is examined and the degree of removal evaluated.

The additives tested are as follows:

1. None (ie, base oil only).
2. 1000 MW low-reactive polyisobutene (PiB) succinate in 33% SN 150 oil.
3. 40% 1000 MW low-reactive PiB succinate/60% 2300 MW low-reactive PiB succinate in 33% SN 150 oil.
4. 40% 1000 MW high-reactive PiB succinate/60% 2300 MW high-reactive PiB succinate in 33% SN 150 oil.
5. 50% ramified polymeric carboxylic acids in aliphatic solvent.
6. Dodecylbenzenesulphonic acid.

Low-reactive PiB is "Hyvis" obtainable from BP Chemicals. High-reactive PiB is "Glissopal" obtainable from BASF. Dodecylbenzenesulphonic acid is "LA AB90" obtainable from Manro.

In cases 1 to 5, the appearance of the lacquer is essentially as before the test—ie, the additive has had no effect. In case 6, however, a significant amount of the lacquer is removed.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A fuel composition, comprising:

a marine diesel fuel; and a liner lacquering reducing amount of a hydrocarbyl-substituted sulphonic acid wherein said marine diesel fuel has a 90% by volume recovery during distillation of greater than 340° C., an aromatics content of greater than 25% by weight, and a sulphur content of less than 2% by weight.

2. A fuel composition, comprising:

a marine diesel fuel; and a liner lacquering reducing amount of an additive composition, said additive composition comprising a hydrocarbyl-substituted sulphonic acid and fuel soluble carrier or solvent wherein said marine diesel fuel has a 90% by volume recovery during distillation of greater than 340° C., an aromatics content of greater than 25% by weight, and a sulphur content of less than 2% by weight.

3. A process for reducing liner lacquering in a marine diesel engine, comprising:

operating said diesel engine using a fuel composition comprising a marine diesel fuel and a liner lacquering reducing amount of a hydrocarbyl-substituted sulphonic acid wherein said marine diesel fuel has a 90% by volume recovery during distillation of greater than 340° C., an aromatics content of greater than 25% by weight, and a sulphur content of less than 2% by weight.

4. The composition of claim 1 wherein said sulphonic acid is a ($C_1$–$C_{24}$) alkyl sulphonic acid, a ($C_6$–$C_{24}$) aryl sulphonic acid, or a ($C_1$–$C_{24}$) alkyl ($C_6$–$C_{12}$) aryl sulphonic acid.

5. The composition of claim 1 wherein said sulphonic acid is an alkyl substituted benzene sulphonic acid, alkyl substituted napthylene sulphonic acid, or para-alkyl substituted phenol sulphonic acid.

6. The composition of claim 1 wherein said sulphonic acid is dodecylbenzene sulphonic acid.

7. The composition of claim 1 wherein the concentration of said sulphonic acid in said fuel composition is in the range of 10 to 10,000 ppm.

8. The composition of claim 1 wherein said fuel composition further comprises at least one of a detergent, combustion improver, cetane improver, emulsifier, antioxidant, antifoam agent, corrosion inhibitor, wax crystal modifier or distillate flow improver.

* * * * *